United States Patent [19]

Bridger et al.

[11] 3,966,620

[45] June 29, 1976

[54] LUBRICANT COMPOSITIONS

[75] Inventors: Robert F. Bridger, Hopewell; Albert L. Williams, Hopewell Township, both of N.J.

[73] Assignee: Mobil Oil Corporation, New York, N.Y.

[22] Filed: Aug. 11, 1975

[21] Appl. No.: 603,428

[52] U.S. Cl. ..... 252/33.4; 252/51.5 A; 252/52 R; 252/392

[51] Int. Cl.[2] ..... C10M 1/40; C10M 3/34; C10M 1/32; C10M 3/26

[58] Field of Search ..... 252/33.4, 51.5 A, 52 R, 252/392

[56] References Cited

UNITED STATES PATENTS 3,897,350 7/1975 Heiba et al. ..... 252/33.4

*Primary Examiner*—Delbert E. Gantz
*Assistant Examiner*—I. Vaughn
*Attorney, Agent, or Firm*—Charles A. Huggett; Raymond W. Barclay; Claude E. Setliff

[57] ABSTRACT

The invention provides lubricant compositions containing (1) a product of reaction between an alkenylsuccinic anhydride and trishydroxymethylaminomethane and (2) an anti-rust amount of 1,1′-binaphthol.

9 Claims, No Drawings

LUBRICANT COMPOSITIONS

BACKGROUND OF THE INVENTION

1. Field of the Invention

This invention relates to lubricant compositions having improved rust inhibition and in particular to oil compositions containing a mixture of oil additives.

2. Discussion of the Prior Art

A desirable function of lubricants used in automotive, marine and railroad engines, or in other engines, is the ability to prevent rust of the metal parts. Such rust is often caused by moisture which usually condenses from the atmosphere and collects inside the engine. It is known, however, the unmodified lubricants, such as lubricating oils, or greases made therefrom, will not prevent the formation of rust on the metal surfaces with which they are in contact. Therefore, a great deal of effort has gone into the development of an additive, or an additive system, that will control rust formation.

One example of the oil additives that have been used as rust inhibitors are the metal sulfonates, both neutral and overbased complex sulfonates. Reference to U.S. Pat. Nos. 2,616,911, 2,721,843, 2,739,124, 2,856,360, 2,861,951, 3,658,703, 3,155,616 are examples of those patents that teach typical preparations of the overbased metal sulfonates.

Other useful rust inhibitors for use in lubricants are the naphthols or polyhydroxy naphthalenes.

SUMMARY OF THE INVENTION

In accordance with the invention, there are disclosed lubricant compositions comprising (1) lubricant, (2) from about 0.5% to about 30% by weight, preferably from about 1% to about 15% by weight of the product of reaction between (a) alkenylsuccinic anhydride (or acid), wherein the alkenyl has a number average molecular weight of from about 200 to about 4,000 and (b) trishydroxymethylaminomethane and (3) an antirust amount of a binaphthol.

DESCRIPTION OF SPECIFIC EMBODIMENTS

Many phenolic compounds possess some antirust activity, and for effective and long-lasting action, they must be able to function in the presence of a variety of other additives. Today's lubricants contain various additive packages, the individual additives functioning as EP agents, detergents, antioxidants, viscosity index improvers, coloring agents, metal scavengers, and the like. Even under the best of circumstances, however, most phenols are readily oxidized, tending to be quickly reduced to concentrations below that where they have antirust capacity. 2-Naphthol is an example of a phenol which is a good antirust agent but which will deteriorate after a time in a highly oxidative environment.

It has been surprisingly discovered that, unlike 2-naphthol, the dehydrodimer, 1,1'-di-2-naphthol has lasting antirust activity, but only when in the presence of a product made by reacting an alkenylsuccinic anhydride, as already defined, with trishydroxymethylaminomethane.

As is evident, therefore, this invention has as one of its essential features the presence of the reaction product mentioned above. In general the product can be simply prepared by reacting a polyalkenylsuccinic anhydride with trishydroxymethylaminomethane until the acid value is less than about 10 at a temperature of from about 125°C to about 2000°C, preferably about 150°C. The anhydride can be used in amounts equivalent to the amino reactant, or it can be used in varying amounts based on the moles of amino compound. Also see CA 62, 8918 f (1965).

As one of the other possible additives, already mentioned, a metal organosulfonate or an overbased metal sulfonate may be used. These organosulfonate additives are well known in the art. Generally they are Group II metal salts, such as barium, strontium, calcium, magnesium and zinc. Alkali metal sulfonates are also useful in this invention. Neutral sulfonates are readily prepared by reacting a metal oxide or hydroxide with the sulfonic acid. Methods of increasing the metal content to produce overbased sulfonates including treating the reaction mixture (containing excess metal oxide or hydroxide) with carbon dioxide. Carbonate-sulfonate metal complexes are formed. (U.S. Pat. Nos. 2,956,018, 3,027,325, 3,036,971 and 3,158,572 show these and other methods of preparing these sulfonate complexes). The preferred sulfonic acid has the formula

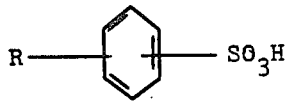

or alkylbenzene sulfonates, wherein R represents one or more alkyl groups. R may contain from 8 to 50 carbon atoms, preferably 8 to 30. Wax benzene sulfonic acids, octadecyl sulfonic acid, and mixed $C_{14}$ to $C_{24}$ alkylbenzene sulfonic acids are preferred. The metal content of the resulting salts may contain over 200% excess metal (as in U.S. Pat. No. 3,436,347). The specific manner of preparing the neutral or overbased metal sulfonates used herein is not within the scope of this invention.

The bi-naphthol is conventional and is readily available. For example, 1,1'-bi-2-naphthol is organic compound No. 1834 in the 37th Edition of the Handbook of Chemistry and Physics (1955–1956).

The bi-naphthol may be present in the lubricant composition at concentrations ranging from about 0.1% to about 10% by weight, and the anhydride-amino product may range from about 0.5% to about 30% by weight. The metal organosulfonate will range from about 1% to about 20% by weight.

The additive mixture of this invention can be used in any one of a wide variety of oils and lubricating viscosity, such as natural, refined or synthetic oils, or in blends of such oils or in greases prepared from such oils. As has already been stated, these oils may be prepared with or without auxiliary conventional additives such as: oiliness and extreme pressure agents; viscosity index improving agents; coloring agents and auxiliary detergents. The useful oils include mineral oils, both naphthenic and paraffinic, either or both containing aromatic fractions. They also include among the synthetic oils the synthetic hydrocarbon oils as well as synthetic ester oils prepared from, for example, monohydric alcohols and polyfunctional acids or from the polyhydric alcohols and monofunctional acids. In this latter category are esters prepared from pentaerythritol and a $C_5$ aliphatic mono acid such as valeric acid or from such alcohol and a mixture of $C_5$–$C_9$ aliphatic mono acids. The compositions are useful for such purposes as gear oils, turbine oils, hydraulic oils and lubricating oils, including those employed in high performance engines.

EXAMPLES

In Table I, the various ingredients were obtained or prepared as follows:

1,1'-bi-2-naphthol

Commercially obtained.

Alkenylsuccinic anhydride-trishydroxymethylamino methane product 32,000 pounds of polybutenylsuccinic anhydride, 80% active in 20% 100 second mineral oil (the polybutenyl portion having an average molecular weight of 1300), and 2600 pounds of trishydroxymethylaminomethane were mixed in a suitable reactor and heated to 150°C under a vacuum of 25–28 inches of mercury until the acid value was less than 10. During the reaction 388 pounds of water were removed. The product was then diluted to 55% activity with 16,400 pounds of 100 second mineral oil. The total weight, with added oil was 50,612 pounds. The product had a hydroxyl value of between 40 and 50, an amine value of 7, an acid value of less than 10 and a viscosity of 140 cs at 210°F.

Amoco 6416

A mixture of zinc dithiophosphate and overbased magnesium alkylbenzene sulfonate-calcium phenate (the latter formed from alkylphenol cross-linked with sulfur). The mixture has a total base number (TBN) of 100.

Lubrizol 690

An overbased calcium alkylbenzene sulfonate having a TBN of 300.

Lubrizol 936

A polyolcarboxylate ester made by reacting polybutene with maleic anhydride and then reacting the product formed with pentaerythritol.

Alkenyl-1400-succinic anhydride - Na sulfanilate product

The alkenyl-1400-succinic anhydride (20,158 ≈ 10.75 moles) was heated to 70°–80°C with stirring under nitrogen. To this were added 2,500 g (10.75 moles) of the trimethylamine salt of sulfanilic acid. The mixture was held at 165°C with stirring under nitrogen for 16 hours. Then 430 g of sodium hydroxide (10.75 moles) predissolved in 1800 ml of methyl alcohol were added slowly, after first cooling the flask to 80°C under nitrogen. The contents were then heated and held under a nitrogen flush at 165°C for 6 hours. The sodium sulfanilate product was then diluted in the pot with 7300 g of process oil to facilitate handling before being used to formulate blends.

EVALUATION OF PRODUCTS

The test procedure is an engine test, Reference Sequence II C Test Method, described in ASTM Special Technical Publication 315F (51 pages). The test method was designed to relate particularly to short trip service under winter conditions and is especially useful in evaluating rusting characteristics of motor oils subjected to low-temperature field service.

SUMMARY OF METHOD

Prior to each test run, the engine is completely disassembled, solvent cleaned, measured, and rebuilt in strict accordance to furnished specifications. Following the preparation, the engine is installed on a dynamometer test stand equipped with the appropriate accessories for controlling speed, load, temperatures, and other various engine operating conditions. The engine is operated continuously for 28 hours under conditions of moderate engine speed, partially warmed-up jacket coolant temperature, and rich air-fuel ratio. Following is a summary of these operating conditions:

| | |
|---|---|
| Speed, rpm | 1500 ± 20 |
| Load, bhp | 25 ± 2 |
| Oil, to engine, after filter, deg. F | 120 ± 2 |
| Oil pump outlet, psi | 50 ± 10 |
| Coolant, jacket out, deg. F | 110 ± 1 |
| Coolant, jacket in, deg. F | 105 ± 1 |
| Collant, jacket flow rate, gpm | 60 ± 1 |
| Coolant, crossover out, deg. F at gpm | 109 ± 2 at 3.0 ± 5 |
| Coolant, crossover pressure outlet, psi | 2.5 ± 0.5 |
| Coolant, breather tube out, deg. F at gpm | 60 ± 2 at 3.0± 0.5 |
| Coolant, rocker covers out, deg F at gpm per cover | 60 ± 2 at 1.5 ± 0.5 |
| Coolant out, rocker cover pressure, psi | 5.0 ± 0.5 |
| Air-fuel ratio | 13.0 ± 0.5 |
| Carburetor, air temp., deg. F | 80 ± 2 |
| Carburetor, air humidity, grains per lb. of dry air | 80 ± 5 |
| Carburetor, pressure, in. water | 0.1 to 0.3 |
| Blowby rate, cmf at 100 F and 29.7 in. Hg | 0.8 ± 0.1 |
| Intake manifold vacuum, in. Hg | 18 ± 1.5 |
| Exhaust back pressure, in. water | 4 ± 1 |
| Exhaust back pressure max. differential, in. water | 0.2 |
| Crankcase oil filter tube | removed and plugged |

Immediately following this 28-hour period of operation, the engine is operated for 2 hours under the same conditions as above, except for the following changes:

| | |
|---|---|
| Coolant, jacket out, deg. F | 120 + 1 |
| Coolant, jacket in, deg. F | 115 + 1 |
| Coolant, crossover out, deg. F | 119 ± 2 |

The engine is then shut down for 30 minutes to change the carburetor, perform an oil level check, change the spark plugs, and to make adjustments to the rocker cover coolant system. Following this shutdown and without oil drain the engine is operated for 2 hours under the following hot conditions.

| | |
|---|---|
| Speed, rpm | 3600 ± 20 |
| Load, bhp | 100 ± 2 |
| Oil, into engine, after filter, all viscosities, deg. F | 260 ± 2 |
| Coolant, jacket out, deg. F | 200 ± 2 |
| jacket in, deg. F | 190 ± 2 |
| jacket flow rate, gpm | 60 ± 1 |
| Intake crossover out, deg. F | 197 ± 2 |
| breather tube out, deg. F at gpm | 199 ± 2 at 3.0 ± 0.5 |
| rocker cover out, deg. F at gpm | 198 ± 2 at 1.5 ± 0.5 |
| rocker over pressure, psi | 5.0 ± 0.5 |
| Air-Fuel Ratio | 16.5 ± 0.5 |
| Carburetor, air temp., deg. F | 80 ± 2 |
| air humidity, grains per lb of dry air | 80 ± 5 |
| Pressure, in. water | 0.1 to 0.3 |
| Blowby rate, cfm at 100 deg. F and | |

-continued

| | |
|---|---|
| 29.7 in. Hg | 2.2 ± 0.2 |
| Intake manifold vacuum, in. Hg | 11 ± 2.5 |
| Exhaust back pressure, in. water | 30 ± 2 |
| Exhaust back pressure, max., differential, in. $H_2O$ | 0.2 |
| Crankcase oil filler tube | removed and plugged |

INSPECTION

On completion of the test, the engine is completely disassembled and inspected for rusting using the appropriate Coordinating Research Council (CRC) rating techniques. Parts rated are indicated below:

Rust — (CRC Manual No. 7). Engine rust rating is the average of five parts listed below:

Valve lifter bodies
Valve lifter plungers
Valve lifter balls
Oil pump relief valve
Push rods The oil used in the test was a Mid-Continent sweet base oil of SAE30 viscosity grade. Results of the test are shown in Table I.

TABLE I

RUST TEST RESULTS

| | | | | |
|---|---|---|---|---|
| Phenolic Antirust Agent | None | 1,1'-Bi-2-naphthol (0.5%) | 1,1'-Bi-2-naphthol (0.3%) | 2-Naphthol (0.5%) |
| Dispersant | XRT-961-C (4.54%) | XRT-961-C (4.54%) | XRT-961-C (4.54%) | XRT-961-C (4.54%) |
| Overbased Sulfonate | Amoco 6416 (3.20%) Mg-Ca Salt | Amoco 6416 (3.20%) Mg-Ca Salt | Amoco 6416 (3.20%) Mg-Ca Salt | Amoco 6416 (3.20%) Mg-Ca Salt |
| ICC Rating[1] | 7.8 | 9.0 | 7.9 | 8.0 |
| Phenolic Antirust Agent | 1.1'-Bi-2-naphthol (0.5%) | None | 1,1'-Bi-2-naphthol (0.5%) | None |
| Dispersant | Lubrizol-936 (3.50%) Polyol Ester | Lubrizol-936 (3.50%) Polyol Ester | Alkenyl-1400-succinic anhydride sodium sulfanilate reaction product (4.84%) | Alkenyl-1400-succinic anhydride sodium sulfanilate reaction product (4.84%) |
| Overbased Sulfonate | Lubrizol-690 (1%) Ca Salt | Lubrizol-690 (1%) Ca Salt | Lubrizol-690 (1%) Ca Salt | Lubrizol-690 (1%) Ca Salt |
| ICC Rating[1] | 6.3 | 8.7 | 6.4 | 8.5 |

[1]A rating of 8.4 is required to pass this test.

We claim:

1. A lubricant composition comprising (1) a major proportion of a lubricant, (2) from about 0.5% to about 30% by weight of the product of reaction between (a) a polyalkenylsuccinic anhydride or acid, wherein the polyalkenyl has a number average molecular weight of from about 200 to about 4,000 and (b) trishydroxymethylaminomethane and (3) an antirust amount of a bi-naphthol.

2. The composition of claim 1 wherein the bi-naphthol is 1,1'-bi-2-naphthol.

3. The composition of claim 1 wherein the polyalkenyl has a number average molecular weight of 1,400.

4. The composition of claim 1 having additionally therein a metal organosulfonate.

5. The composition of claim 4 wherein the metal organosulfonate is an overbased metal organosulfonate.

6. The composition of claim 5 wherein the overbased metal sulfonate is calcium alkyl benzene sulfonate.

7. The composition of claim 1 wherein the lubricant comprises a lubricating oil.

8. The composition of claim 1 wherein the lubricant comprises a grease.

9. The composition of claim 7 wherein the lubricating oil is a mineral lubricating oil.

* * * * *